US006470856B1

(12) United States Patent
Boecking

(10) Patent No.: US 6,470,856 B1
(45) Date of Patent: Oct. 29, 2002

(54) METHOD FOR MACHINING A HIGH PRESSURE FUEL ACCUMULATOR, HIGH PRESSURE FUEL ACCUMULATOR AND CONNECTOR BRANCHES FOR USING SAID METHOD

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/857,629

(22) PCT Filed: Sep. 19, 2000

(86) PCT No.: PCT/DE00/03246

§ 371 (c)(1),
(2), (4) Date: Sep. 5, 2001

(87) PCT Pub. No.: WO01/25616

PCT Pub. Date: Apr. 12, 2001

(30) Foreign Application Priority Data

Oct. 7, 1999 (DE) ..... 199 48 338

(51) Int. Cl.[7] ..... F02M 37/04

(52) U.S. Cl. ..... 123/456; 123/468; 123/469; 29/888.01

(58) Field of Search ..... 123/456, 468, 123/469, 470; 29/888.01

(56) References Cited

U.S. PATENT DOCUMENTS 5,775,302 A * 7/1998 Guido et al. ..... 123/465
6,126,208 A * 10/2000 Asada et al. ..... 123/468
6,213,095 B1 * 4/2001 Asada et al. ..... 123/456
6,263,862 B1 * 7/2001 Asada et al. ..... 123/456
6,279,540 B1 * 8/2001 Greaney et al. ..... 123/470
6,317,975 B1 * 11/2001 Asada ..... 29/888.01
2001/0029929 A1 * 10/2001 Natsume ..... 123/468
2002/0005186 A1 * 1/2002 Asada ..... 123/456

FOREIGN PATENT DOCUMENTS

DE 198 08 894 A1 9/1998
DE 198 32 903 A1 9/1999

* cited by examiner

*Primary Examiner*—Thomas N. Moulis
(74) *Attorney, Agent, or Firm*—Ronald E. Greigg

(57) ABSTRACT

The invention relates to a method for machining a common rail for a common rail fuel injection system of an internal combustion engine, having a base body, which is equipped with a plurality of connection openings. The invention also relates to a common rail and to a connection stub for application of the method. In the method, the base body is deformed in the region of the connection openings. In the region of each of the connection openings, one through bore is provided, which has two segments of different-sized internal diameters. The connection stub of the invention is characterized in that the outside diameter of the connection stub, on its end toward the common rail, is substantially equivalent to the internal diameter of the segment of the through bore in the common rail having the larger diameter.

20 Claims, 2 Drawing Sheets

METHOD FOR MACHINING A HIGH PRESSURE FUEL ACCUMULATOR, HIGH PRESSURE FUEL ACCUMULATOR AND CONNECTOR BRANCHES FOR USING SAID METHOD

CROSS REFERENCE TO RELATED APPLICATIONS

This application is a 35 USC 371 application of PCT/DE 00/03246 filed on Sep. 19, 2000.

BACKGROUND OF THE INVENTION

1. Field of the Invention

The invention relates to a method for machining a common rail for a common rail fuel injection system of an internal combustion engine, having a base body, which is equipped with a plurality of connection openings. The invention also relates to a common rail and to a connection stub for application of the method.

2. Description of the Prior Art

In common rail fuel injection systems, a high-pressure pump, optionally with the aid of a prefeed pump, pumps the fuel to be injected out of a tank into the central high-pressure fuel reservoir, which is also called a common rail. From the rail, fuel lines lead to the various injectors that are assigned one to each of the cylinders of the engine. To inject fuel into the combustion chamber of the engine, the injectors are triggered individually by the engine electronics as a function of the engine operating parameters. By means of the common rail, the pressure generation and the injection are decoupled from one another. One conventional common rail is described for instance in German Patent Disclosure DE 195 48 611. The conventional common rail withstands pressures of up to about 1100 bar.

OBJECTS AND SUMMARY OF THE INVENTION

The primary object of the invention is to increase the high-pressure strength of the known common rail by simple provisions.

In a method for machining a common rail for a common rail fuel injection system of an internal combustion engine, having a base body, which is equipped with a plurality of connection openings, this object is attained in that the base body is deformed in the region of the connection openings. Within the context of the present invention, it has been demonstrated that the high-pressure strength of the common rail is limited primarily by the intersections between the connection openings and the base body. In the region of the transitions between the connection openings and the base body, high tensile forces occur during operation. By rounding them off, the transitions between the connection openings and the base body can be made no longer sharp. As a result, the high-pressure strength of the common rail can be enhanced. However, the rounding entails very great effort and high cost. By the mechanical deformation, according to the invention, of the base body, the high-pressure strength of the common rail is enhanced in a much simpler way. The common rail of the invention withstands pressures of over 2000 bar. Advantageously, the provisions according to the invention can be combined with the known provisions, such as rounding the intersections, in order to achieve even better results. The teaching of the invention can also be combined with an eccentric disposition of the connection openings.

A particular embodiment of the method of the invention is characterized in that the base body, in the region of the connection openings, is elastically deformed from outside with the aid of a connection stub. By the mechanical deformation of the base body in the critical region of the intersections, intrinsic pressure stresses are introduced into the region of the intersections. By means of the internal pressure prevailing in the interior of the base body during operation of the common rail, the intrinsic pressure stresses generated in the pressureless state are cancelled out. As a result, the region of the base body that has critical tensile stresses is markedly reduced in size.

In a common rail for application of the method described above, the above-stated object is attained in that in the region of each of the connection openings, one through bore is provided, which has two segments of different-sized internal diameters. By means of the elastic deformation from outside, the bottom of the connection opening, formed by the segment of the through bore having the smaller internal diameter, is deformed inward elastically.

A particular feature of the common rail of the invention is characterized in that a female thread is embodied in the segment of the through bore having the larger internal diameter. The female thread serves to receive a connection stub, which in turn serves to connect high-pressure fuel lines.

In a connection stub for application of the above-described method, the above-stated object is attained in that the outside diameter of the connection stub, on its end toward the common rail, is substantially equal to the internal diameter of the larger diameter segment of the through bore in the common rail. Upon assembly of the connection stub of the invention, the end of the connection stub toward the common rail is pressed against the bottom of the connection opening. As a result, on the one hand the connection opening is sealed off from its surroundings, and on the other, the desired deformation of the bottom of the connection opening is attained.

A particular feature of the connection stub of the invention is characterized in that on the end of the connection stub toward the common rail, a male thread is embodied that is complimentary to the female thread of the through bore. Via the thread, the contact pressure required for the sealing and the deformation is generated. By means of a defined tightening moment and a suitable geometry of the region to be deformed, the magnitude and the direction of the deformation of the critical region of the connection opening can be adjusted.

A further feature of the method of the invention is that in the base body, a rigid internal tube is disposed whose outer contour corresponds to the desired inner contour of the base body in the region of the connection openings, and in that the base body, in the region of the connection openings, is deformed from outside plastically inward with a tool. According to the present invention, the base body is compressed inward in the region of the transitions between the connection openings and the base body. The internal tube serves in a sense as a template for the base body in the region of the connection openings and remains in the base body after the deformation. By the deformation of the base body, the region of the greatest tensile stress is removed from the region of the intersection, which has an advantageous effect on the high-pressure strength of the common rail.

A further feature of the method of the invention is that the internal tube is elastically deformed in the plastic deformation of the base body. In the ideal state, it is attained that the internal tube rests with its full surface against the base body once the deformation is concluded.

A further feature of the method of the invention is that during the deformation of the base body, a mandrel is introduced into the internal tube. With the mandrel, an undesired plastic deformation of the internal tube during the deformation of the base body is avoided.

BRIEF DESCRIPTION OF THE DRAWINGS

The above and other features of the invention will become apparent from the ensuing description, taken in conjunction with the drawings, in which.

DESCRIPTION OF THE PREFERRED EMBODIMENT

Figure 1:
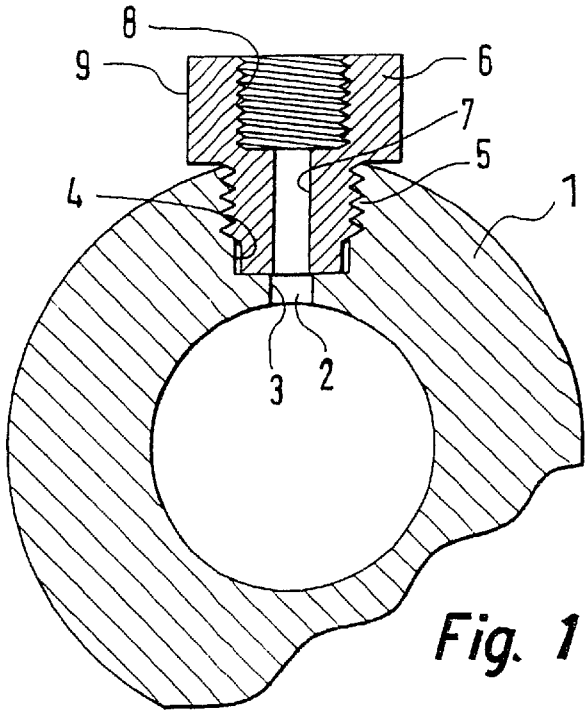
FIG. 1 is a cross section of a first embodiment of a common rail of the invention.
Figure 2:
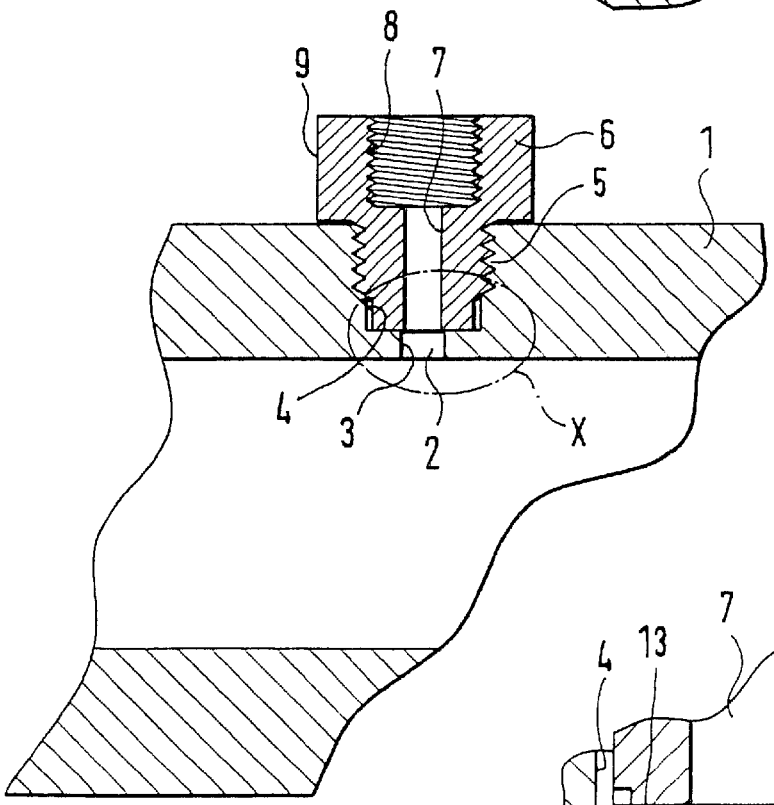
FIG. 2 is a fragmental longitudinal section of the common rail of FIG. 1.
Figure 3:
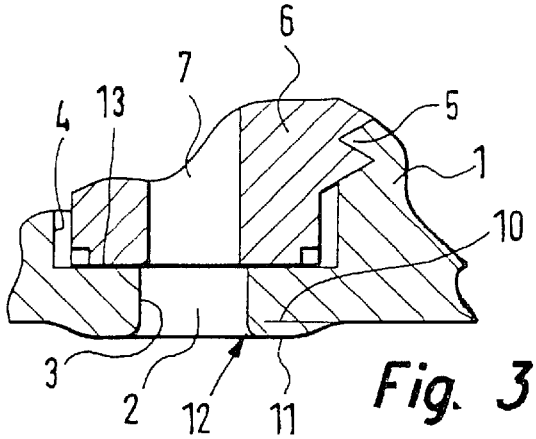
FIG. 3 is an enlarged view of the detail marked X in FIG. 2.

The common rail shown in FIGS. 1–3 is formed from a tubular base body 1. A connection bore 2 is disposed in the radial direction in the tubular base body 1. The connection bore 2 has two segments 3 and 4 of different internal diameters. The segment 3 having the smaller diameter is disposed on the side toward the interior of the tubular base body 1. The segment 4 of larger internal diameter follows the segment 3 having the smaller internal diameter. A female thread 5 is embodied in the segment 4 having the larger internal diameter. The female thread 5 in the segment 4 of the connection bore 2 cooperates with a male thread that is embodied on the connection stub 6.

The segment 4 of the connection bore 2 having the larger internal diameter serves to receive the end of a connection stub 6. A through bore 7 is recessed out of the connection stub 6 and connects the interior of the tubular base body 1 with a high-pressure fuel line (not shown). For securing the high-pressure fuel line, a female thread 8 is embodied in the head of the connection stub 6. On the outside, the head of the connection stub 6 is provided with a hexagonal contour 9. The hexagonal contour 9 forms an engagement face for a tool.

By means of an elastic deformation of the connection stub 6, done from outside, the segment 3 of the connection bore 2 having the smaller diameter is deformed elastically toward the interior of the tubular base body 1. In FIG. 3, the contour of the critical region is indicated in the unstressed state at 10 and in the stressed state at 11.

The end face of the connection stub 6 toward the interior of the tubular base body 1 performs two functions in the present invention. First, pressing the end face of the connection stub 6 against the segment 3 of the connection bore 2 assures sealing off of the interior of the common rail, subjected to high pressure, from its surroundings, and second, the end face of the connection stub 6 serves to transmit the requisite force for the deformation to the segment 3 of the connection bore 2.

The force required for the deformation is transmitted into the critical region of the segment 3 of the connection bore 2 having the smaller internal diameter via the external hexagon 9, the male thread, complimentary to the female thread 5, of the connection stub 6, and the end face of the connection stub 6 toward the interior of the tubular base body 1. By means of a defined attaching moment, the deformation can be adjusted in a defined way.

Because material used is deformed elastically in the critical region at the entrance to the bore, intrinsic pressure stresses can be introduced into the region of the intersection without stress from pressure. Under the internal pressure prevailing during operation, these intrinsic pressure stresses are then cancelled out. As a result, the region of high tensile stresses is markedly reduced in size. In FIG. 3, it is indicated at 12 that in addition to the provisions of the invention, the critical region is also rounded. The step 13 resulting from the different internal diameters of the segments 3 and 4 of the connection bore 2 is also called the bottom of the connection bore 2.

Figure 4:
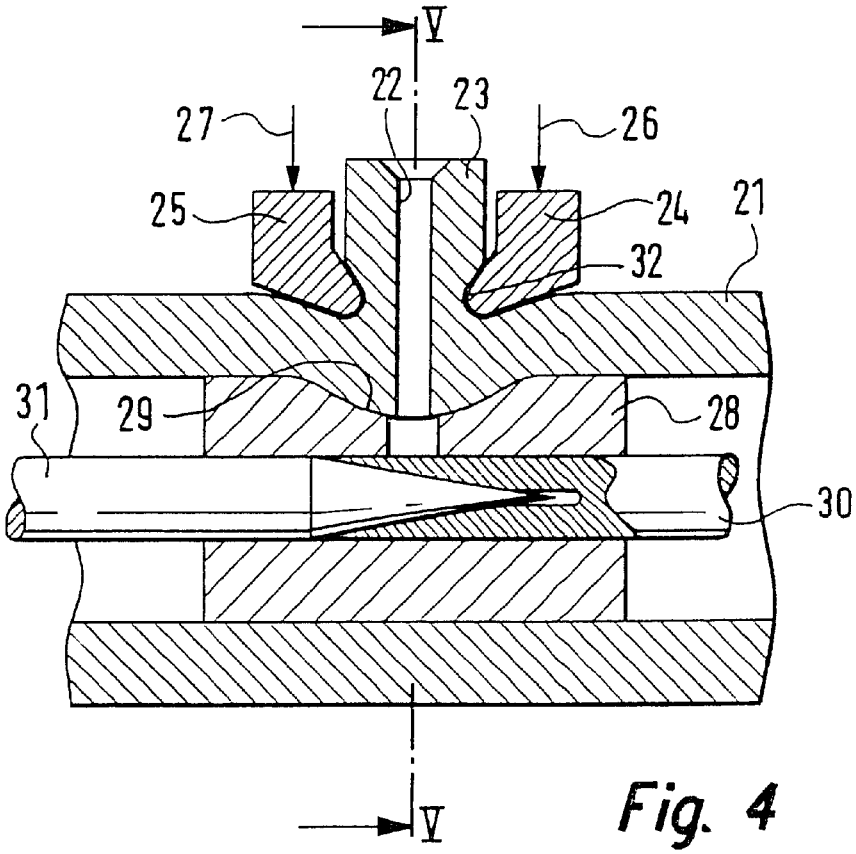
FIG. 4 is a fragmental longitudinal section of a second embodiment of a common rail of the invention.
Figure 5:
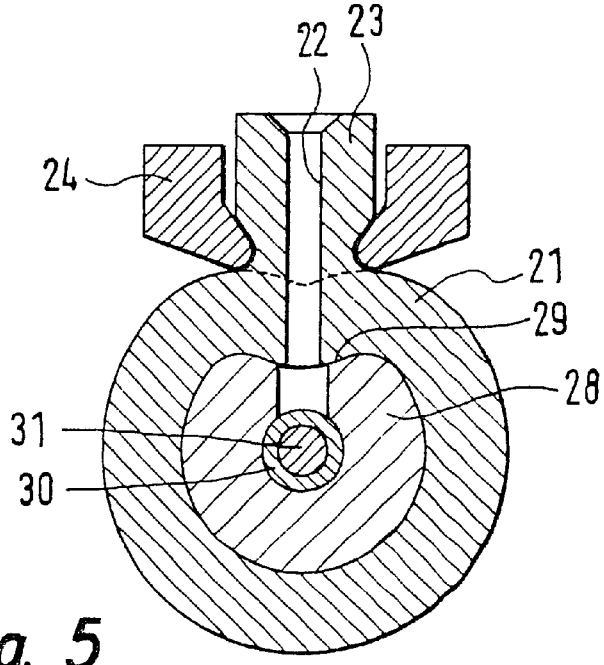
FIG. 5 is a view of a section taken along the line V—V of FIG. 4.

The second embodiment, shown in FIGS. 4 and 5, of a common rail of the invention includes a tubular base body 21. A connection bore 22 extends radially from the interior of the tubular base body 21. The connection bore 22 discharges on the outside into a connection stub 23, which is embodied on the tubular base body 21. The connection stub 23 serves to connect a high-pressure fuel line (not shown).

A circumferential groove 32 is embodied at the transition between the connection stub 23 and the base body 21. The circumferential groove 32 is engaged by a tool formed of two half-round tool halves 24 and 25. The two tool halves 24 and 25 are subjected to force in the direction of the arrows 26 and 27 and are pressed against the tubular base body 21. As a result, the tubular base body 21 deforms in the region of the connection bore 22.

An internal tube 28 is disposed in the interior of the tubular base body 21. A domelike indentation 29 is provided on the outer jacket face of the internal tube 28, in the region of the connection bore 22. A mandrel formed of two parts 30 and 31 is disposed in the interior of the internal tube.

The internal tube 28 is positioned in the tubular base body 21 in such a way that the domelike indentation 29 is located precisely in the region of the connection bore 22. By pressing on the tubular base body 21 in the region of the connection bore 22 with the tool 24, 25, the tubular base body 21 is pressed into the domelike indentation 29 of the internal tube 28. In practical terms, the internal tube 28 forms the template for the pressing operation. With the mandrel 30, 31, an undesired plastic deformation of the internal tube 28 is prevented.

In the plastic deformation of the tubular base body 21, it is important that the internal tube 28 be elastically deformed jointly with it. In the ideal state, after the plastic deformation of the tubular base body 21, the internal tube 28 rests with its full surface against the tubular base body 21, at least in the region of the connection bore 22.

The foregoing relates to preferred exemplary embodiments of the invention, it being understood that other variants and embodiments thereof are possible within the spirit and scope of the invention, the latter being defined by the appended claims.

What is claimed is:

1. A method for producing a common rail for a common rail fuel injection system of an internal combustion engine, the common rail having a base body (1; 21) which is equipped with a plurality of connection openings (2; 22), the method comprising the step of deforming the base body in the region of the connection openings (2; 22), wherein the step of deforming the base body (1), in the region of the connection openings (2), comprises elastically deforming the base body from outside with the aid of a connection stub (6).

2. The method of claim 1, further comprising providing a through bore in the region of each of the connection opening, each said through bore having two segments (3, 4) of different-sized internal diameters.

3. The method of claim 2, further comprising providing a female thread (5) in the segment (4) of the through bore (2) having the larger internal diameter.

4. The method of claim 1, further comprising providing a through bore in the region of each connection opening, each through bore having two segments of different sized internal diameters, and providing each connection stub (6), on its end toward the common rail, with an outside diameter which is substantially equal to the internal diameter of the segment (4) of the through bore (2) in the common rail having the larger diameter.

5. The method of claim 4, further comprising providing a male thread on the end of the connection stub (6) toward the common rail, the male thread being complimentary to the female thread (5) of the through bore (2).

6. A method for producing a common rail for a common rail fuel injection system of an internal combustion engine, the common rail having a base body (1; 21) which is equipped with a plurality of connection openings (2; 22), the method comprising the step of deforming the base body in the region of the connection openings (2; 22), further comprising providing a rigid internal tube (28) in the base body, the internal tube having an outer contour which corresponds to the desired inner contour of the base body (21), in the region of the connection openings (22), and deforming the base body (21), in the region of the connection openings (22) from outside plastically inward with a tool (24, 25).

7. The method of claim 6, further comprising elastically deforming the internal tube (28) in the plastic deformation of the base body (21).

8. The method of claim 6, wherein during the deformation of the base body (21), a mandrel (30, 31) is introduced into the internal tube (28).

9. The method of claim 7, wherein during the deformation of the base body (21), a mandrel (30, 31) is introduced into the internal tube (28).

10. The method of claim 1, further comprising providing a through bore in the region of each of the connection opening, each said through bore having two segments (3, 4) of different-sized internal diameters.

11. The method of claim 10, further comprising providing a female thread (5) in the segment (4) of the through bore (2) having the larger internal diameter.

12. The method of claim 4, further comprising providing a female thread (5) in the segment (4) of the through bore (2) having the larger internal diameter.

13. The method of claim 12, further comprising providing a male thread on the end of the connection stub (6) toward the common rail, the male thread being complimentary to the female thread (5) of the through bore (2).

14. The method of claim 7, wherein during the deformation of the base body (21), a mandrel (30, 31) is introduced into the internal tube (28).

15. A common rail for a common rail fluid injection system of an internal combustion engine, comprising a generally tubular base body, a plurality of connection openings extending through the wall of said tubular base body, each said connecting opening including a through bore having a circular cross section and each having segments of two different internal diameters, a connection stub for each connection opening, each connection stub being assembled to the tubular base body by being inserted into a connection opening, and in the assembly process being brought to a final, assembled position, each connection stub including means which elastically deforms the material of the tubular base body as it is inserted into a connection opening and brought to its final position on the tubular base body.

16. The common rail of claim 15, further comprising a female thread formed in the segment of each through bore which has the largest diameter.

17. The common rail of claim 16, wherein each said connecting stub has an external diameter on an end adjacent said common rail which is substantially equal to the internal diameter of the largest diameter segment of said through bore and having a male thread complimentary to and engaging said female thread of the through bore.

18. A common rail for a common rail fluid injection system of an internal combustion engine formed by the method of claim 1.

19. A common rail for a common rail fluid injection system of an internal combustion engine formed by the method of claim 2.

20. A common rail for a common rail fluid injection system of an internal combustion engine formed by the method of claim 6.

* * * * *